United States Patent [19]

Whaley

[11] 4,312,497

[45] Jan. 26, 1982

[54] HYDRAULIC WINCHES

[75] Inventor: Haskell M. Whaley, Chula Vista, Calif.

[73] Assignee: Morris Whaley, Inc., Chula Vista, Calif.

[21] Appl. No.: 84,060

[22] Filed: Oct. 12, 1979

[51] Int. Cl.[3] ..... B66D 1/22

[52] U.S. Cl. ..... 254/344; 91/45; 192/3 R; 254/355; 254/351

[58] Field of Search ..... 254/344, 361, 355, 900; 192/3 M, 3 N, 3 S, 3 R; 74/792, 789; 91/45

[56] References Cited

U.S. PATENT DOCUMENTS

| | | | |
|---|---|---|---|
| 1,946,145 | 2/1934 | Johnson | 254/344 |
| 1,971,351 | 8/1934 | Osgood | 254/361 |
| 2,163,231 | 6/1939 | Smaltz et al. | 254/361 |
| 2,986,884 | 6/1961 | Smith | 254/361 |
| 3,125,819 | 3/1964 | Kaufmann | 254/361 |

*Primary Examiner*—Billy S. Taylor

*Attorney, Agent, or Firm*—LeBlanc, Nolan, Shur & Nies

[57] ABSTRACT

A grooved winch drum is driven by a reversible hydraulic motor. A pump supplies fluid to the motor through a system using an electrically controlled four-way, flow direction valve associated with a counterbalance valve and a manually adjustable flow control valve. The four-way valve controls the direction of drum rotation and the flow control valve regulates the drum rotational speed. The motor drives the drum through a planetary gearing which includes a ring gear normally held from rotation by a friction clutch band, spring biased into engaged position but releasable by the application of hydraulic pressure from a separate pump supplied through a second system that includes a second flow control valve. The flow control valves for the motor and clutch are each associated with a cam operator mounted on a shaft rotated by a lever which also carries a three position electrical switch to control the four-way valve. The operator can use this control lever to rotate the winch drum over a continuous speed range in either direction or permit free drop of loads independent of the winch motor. The counterbalance valve provides a fail-safe device in case of fluid pressure drop in the drive system.

16 Claims, 3 Drawing Figures

HYDRAULIC WINCHES

The present invention relates to winches and, more particularly, to novel, improved winches of the hydraulic type.

One of the currently important applications of the principles of the present invention is in the provision of combined purpose, brailing and cargo winches for tuna boats; and the principles of invention will accordingly be developed primarily by reference to that application. It is to be understood, however, that this is being done in the interests of brevity and clarity and is not intended to limit the scope of the invention as defined in the appended claims.

"Brailing" is the operation by which tuna are brought aboard from the purse seine in which they are netted.

A brailer is a dip net resembling a giant tea strainer. It has a perforate basket and a long handle and is manipulated from a skiff located alongside the tuna boat with the seine and netted fish between it and the boat.

The brailer is dropped into the purse seine in a vertical position and then juggled up and down while the skiff crew manipulate the handle to a horizontal position, scooping tune from the purse seine into the brailer. The brailer is then hoisted aboard and emptied and the process repeated.

Typically, on the order of 3000 pounds of fish will be brought aboard in the brailer; and a brailing operation as described above is completed in about one minute.

As currently carried out, brailing is an extremely dangerous operation. The brailer is lowered, juggled, and raised by a gypsy head mounted midships the tuna boat deck on the boat's main, or purse seine, winch.

A gypsy head is, generally speaking, nothing more than a continuously rotating, horizontal capstan. By changing the number of wraps on the capstan and/or tightening or loosening the cable on the capstan, the friction between the cable and the capstan and, therefore, the lifting capacity of the gypsy head and the up and down movement of the brailer can be controlled.

This is done by the gypsy head operator who drops the brailer by removing wraps from the gypsy head and/or tightens and slackens the cable; and additional wraps are added to hoist the filled brailer aboard.

The operation of the gypsy head by its operator aboard the tuna boat is directed by whistle signals from a whistler aboard the skiff and out of the gypsy head operator's sight.

Brailing, also, must often be carried out in heavy seas (it is not common for a swell to cause the tuna boat and skiff to move as much as twenty feet up and down relative to each other). The lack of visual communication between the gypsy head operator and the skiff crew and the conditions under which brailing is common carried out result in frequent accidents involving both personal injury and damage to equipment.

My novel winches, as employed in brailing, eliminate the above-discussed disadvantages of gypsy head operation. They allow the winch operator to be in visual contact with the skiff, eliminating the need for whistle signals. This gives the operator direct control over the brailer, providing a safer and more efficient brailing operation.

Also, my novel winches differ advantageously from gypsy head and comparable systems in that they give virtually unlimited control over the raising and lowering of loads in that speed can be continuously varied over a wide range up to that of a free fall; in that the direction of load movement can be rapidly changed to juggle the load, for example; and in that fall-safe operation is provided.

Yet another important advantage of my novel winches in applications of the character under consideration is that they have the characteristics which make them useful as general purpose cargo winches. Consequently, they eliminate the need for the cargo winches currently found on tuna boats, for example. This capability of my novel winches to replace both a gypsy head and a cargo winch is a substantial economic advantage as the cost of each such piece of equipment can run into the tens of thousands of dollars.

Briefly, my novel winches, by which the foregoing and other important advantages are obtained, have a cable drum driven by a reversible, variable speed, hydraulic motor through a hydraulically operated, biased engaged clutch and a control which locks or stalls the motor if a failure occurs. This provides fail-safe operation in that the clutch will automatically engage; and, because the load cannot drive the motor, it will keep the load being handled by the winch from dropping if a failure occurs.

The operations of the winch motor and clutch are controlled by an electromechanical control unit which can be located wherever desired because it is connected to the controlled components only by hydraulic lines and electrical leads. In an application such as that discussed above, this novel arrangement allows the winch to be mounted on the brailing boom of the tuna boat in the location occupied by currently employed cargo winches. The control unit can be put at any location where the winch operator can visually oversee, and thereby directly control, the lowering, juggling, and raising of the brailer during brailing and, also, the handling of cargo.

The control units of the winches I have invented are unique in the degree of control they have over the load being handled by the winch. For example they permit the clutch to be disengaged in less than 150 microseconds from a condition in which the motor is hoisting at maximum speed to drop a load by free fall or at a slower, controlled rate when that is wanted as in a brailing operation. Or, the load can be raised and lowered as rapidly or as slowly as the winch operator may wish within the operating range of the winch by engaging the clutch and regulating the speed and direction of rotation of the motor. And the load can be halted during either lifting or lowering whenever wanted. Also, combinations of various movements such slow lifting followed immediately by free fall of the load are readily available.

Generally speaking, the control units providing the advantages discussed above include two hydraulic fluid flow modulating valves actuated by a single control lever and a three-position, electrical switch mounted on the control lever. One valve so controls the hydraulic pressure on the winch clutch as to engage (or disengage) the clutch to a selected degree, making it possible to lower or drop a load at a selected rate with the winch motor locked.

The electric switch activates a flow controller which allows hydraulic fluid to flow through the second operator-actuated hydraulic valve when the switch is closed. The switch also determines, through the flow controller, the direction in which the winch motor rotates.

The second of the operator-actuated valves is a motor control which is operable with the clutch fully engaged. Initially, as this valve becomes operational, it allows all of the fluid circulated to it to flow to the motor, making maximum motor torque available. As the control lever is moved through the remainder of its travel, the valve is opened by its actuator, bypassing increasing quantities of the hydraulic fluid around the motor and decreasing the motor speed, typically to zero rpm with the control lever at the limit of its travel.

With the control lever in any position in which the motor control valve is energized, the load being handled by a winch in accord with the principles of the present invention can be halted whether it is being raised or lowered simply by releasing the motor control switch. This is an advantage from the viewpoints of both safety and versatility. And the system is again fail-safe because a power failure will produce the same result as will a failure resulting in a loss of hydraulic fluid circulation through the motor of the winch.

Still another advantage of my novel winches is the abovesuggested rapid response of clutch and motor to the control. Also, they are light and compact; and little maintenance is required.

From the foregoing it will be apparent to the reader that the primary object of the present invention resides in the provision of novel, improved, hydraulically operated winches.

Other important but more specific objects of my invention reside in the provision of winches in accord with the foregoing objects:

which are capable of raising and lowering loads safely under even highly adverse conditions;

which, in conjunction with the preceding object, are capable of fail-safe operation;

which afford virtually unlimited control over the raising and lowering of loads being handled thereby;

which are usable in a variety of applications including applications of multi-purpose character;

which can be operated at a location removed from the winch unit proper; that is, the unit in which the cable drum is incorporated;

which have extremely rapid response times;

which are compact and light in weight;

which require minimal maintenance;

which have all, or various combinations, of the foregoing attributes.

Other important objects, features, and advantages of the present invention will become apparent from the appended claims and as the ensuing detailed description and discussion proceeds in conjunction with the accompanying drawing in which:

Figure 1:
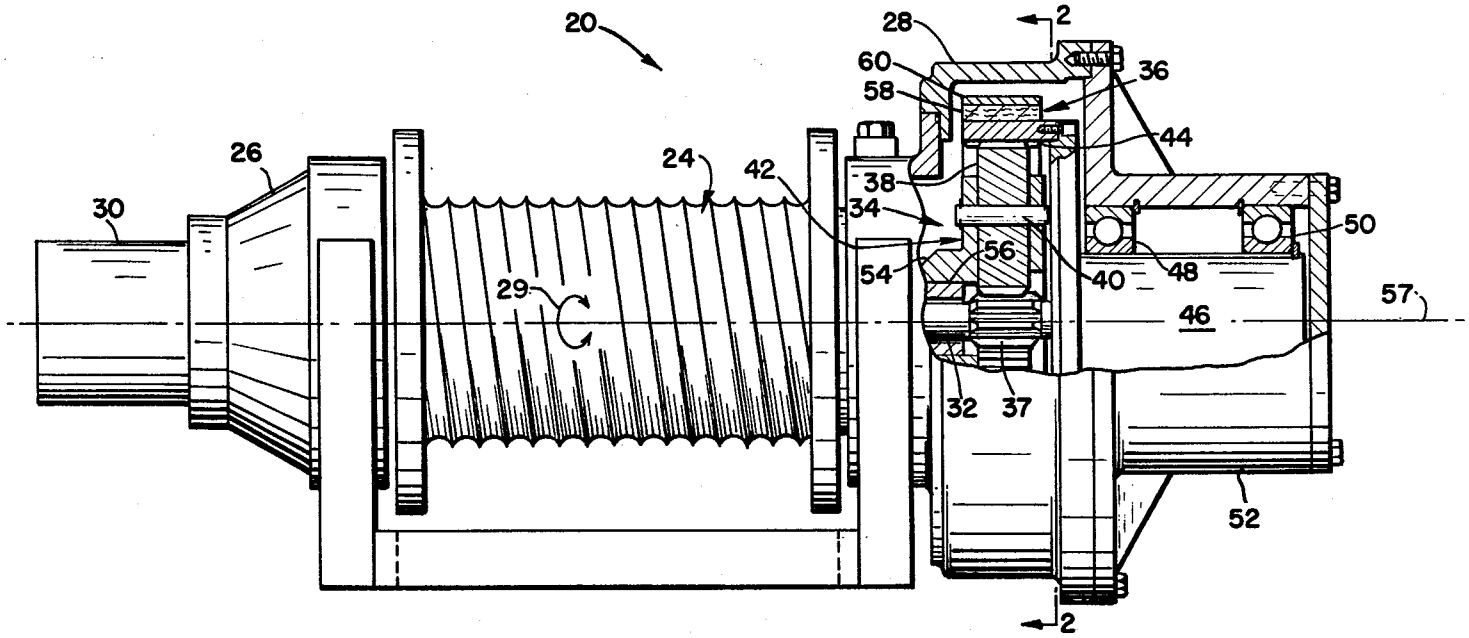
FIG. 1 is a side view of a hydraulic winch embodying the principles of the present invention, part of the winch housing being broken away to show certain of its internal components.

Referring now to the drawing, FIG. 1 depicts a hydraulic winch 20 constructed in accord with the principles of the present invention.

To a considerable extent, winch 20 is of a commercially available construction. Consequently, it will be described herein only to the extent necessary for an understanding of the present invention.

Winch 20 includes a cable drum 24 rotatably supported, at its opposite ends, in a motor end housing 26 and a ring gear housing 28. Cable drum 24 can be reversibly rotated as indicated by arrow 29 in FIG. 1 by a hydraulic motor 30 which is connected to the cable drum through a drive shaft 32, a planetary gear reduction drive 34, and a fail-safe type, hydraulically actuated clutch 36.

The planetary gear reduction drive 34 includes a sun gear 37 fixed to shaft 32 for rotation therewith and planet gears 38 rotatably supported by pins 40 from a gear carrier 42. The planet gears mesh with sun gear 37 and are surrounded by an internal ring gear 44. The latter meshes with planet gears 38 and is fixed, at its outboard end, to a drive plate 46. The drive plate is, in turn, rotatably supported by bearings 48 and 50 mounted in a housing 52 adjacent ring gear housing 28.

The output from planetary gear drive 34 is planet gear carrier 42. The hub 54 of the planet gear carrier is splined or otherwise connected to a hub 56 at the reduction drive end of cable drum 24 so that rotation of the planet gear carrier results in a concomitant rotation of the cable drum.

The planetary gear reduction assembly operates conventionally. To rotate cable drum 24, internal ring gear 44 is held stationary and motor 30 energized, causing sun gear 37 to rotate planet gears 42. As the latter are rotated by the sun gear, they also move around internal gear 44, rotating gear carrier 42 about the axial centerline 57 of the winch and turning the cable drum.

Figure 2:
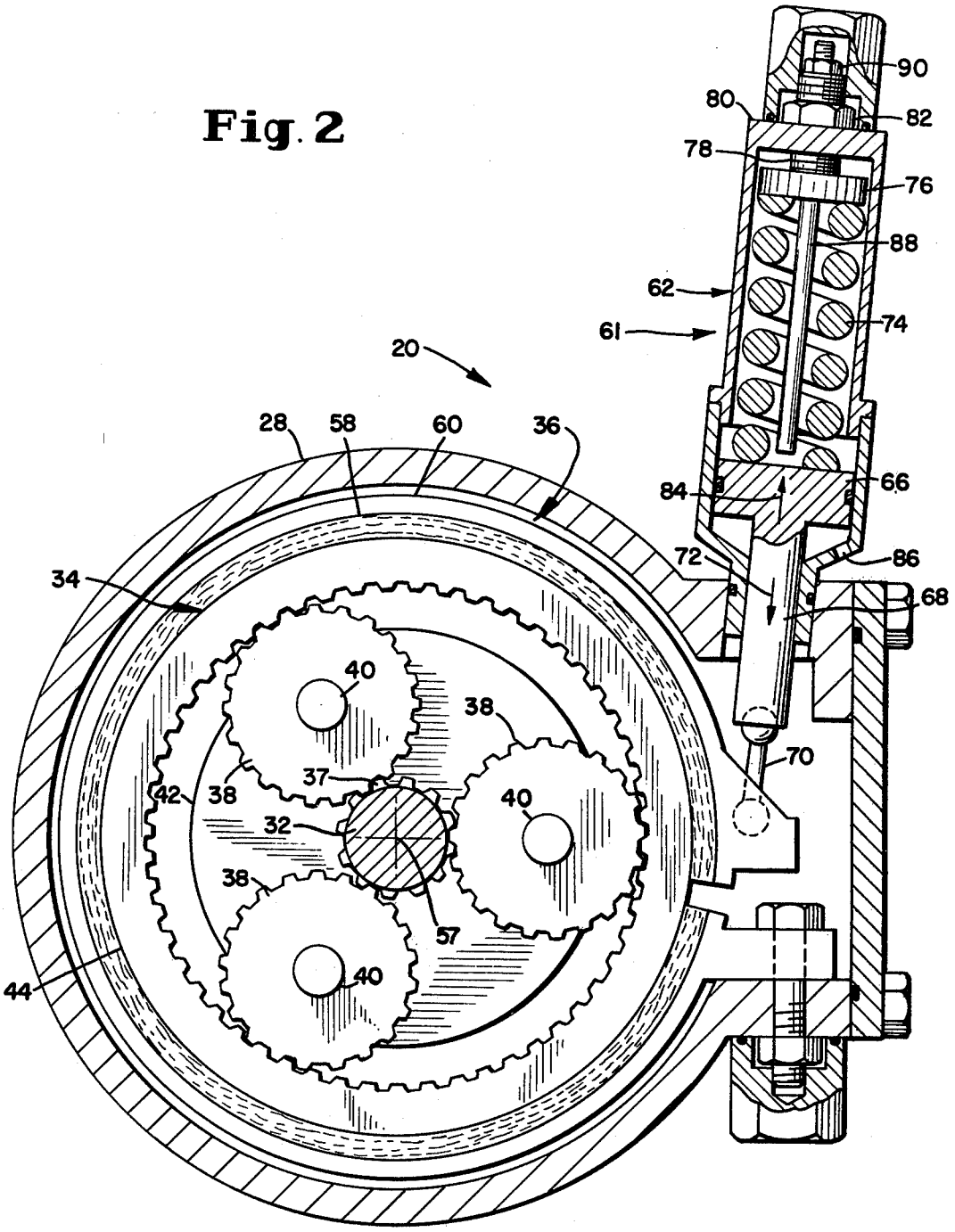
FIG. 2 is a transverse section through the winch taken substantially along line 2—2 of FIG. 1.

Referring now primarily to FIG. 2, ring gear 44 is maintained stationary in the operation just described by the above-mentioned clutch mechanism 36 which includes a clutch lining 58 surrounding ring gear 44, a clutch band 60 surrounding clutch lining 58 with one end bolted or otherwise fixed to ring gear housing 28, and a clutch actuator 61.

The latter includes a hydraulic cylinder 62 mounted on ring gear housing 28. Slidably mounted in the cylinder is a hydraulic piston 66 which has an integral piston rod 68 extending through the end of cylinder 62. The piston rod is connected by a ball link 70 to the free end of clutch band 60.

Piston 66 is continuously biased in the direction indicated by arrow 72 in FIG. 2 to engage the clutch by a high energy, coil spring 74 extending between hydraulic cylinder 62 and a pressure plate 76. The latter is fixed to a pressure plate adjuster 78 threaded through the outboard end 80 of hydraulic cylinder 62, and it is maintained in the position to which it is adjusted by a lock nut 82.

Hydraulic piston 66 is moved in the direction indicated by arrow 84 in FIG. 2 to disengage the clutch by admitting a hydraulic fluid to the interior of cylinder 62 through port 86. The movement of the piston in the clutch disengaging direction is determined by a stroke limiting rod 88 which is threaded through pressure plate adjuster 78 and maintained in the position to which it is adjusted by a lock nut 90.

It will be appreciated that the novel mechanism just described provides fail-safe operation of winch 20. Specifically, if there is a failure in the system supplying hydraulic fluid to clutch actuator 61, spring 74 will immediately displace piston 66 and piston rod 68 in the direction indicated by arrow 72 in FIG. 2. This engages the clutch and stops the rotation of reduction drive ring gear 44. With motor 30 also halted, cable drum 24 is thereby kept from rotating, keeping the winch from dropping the load.

Figure 3:
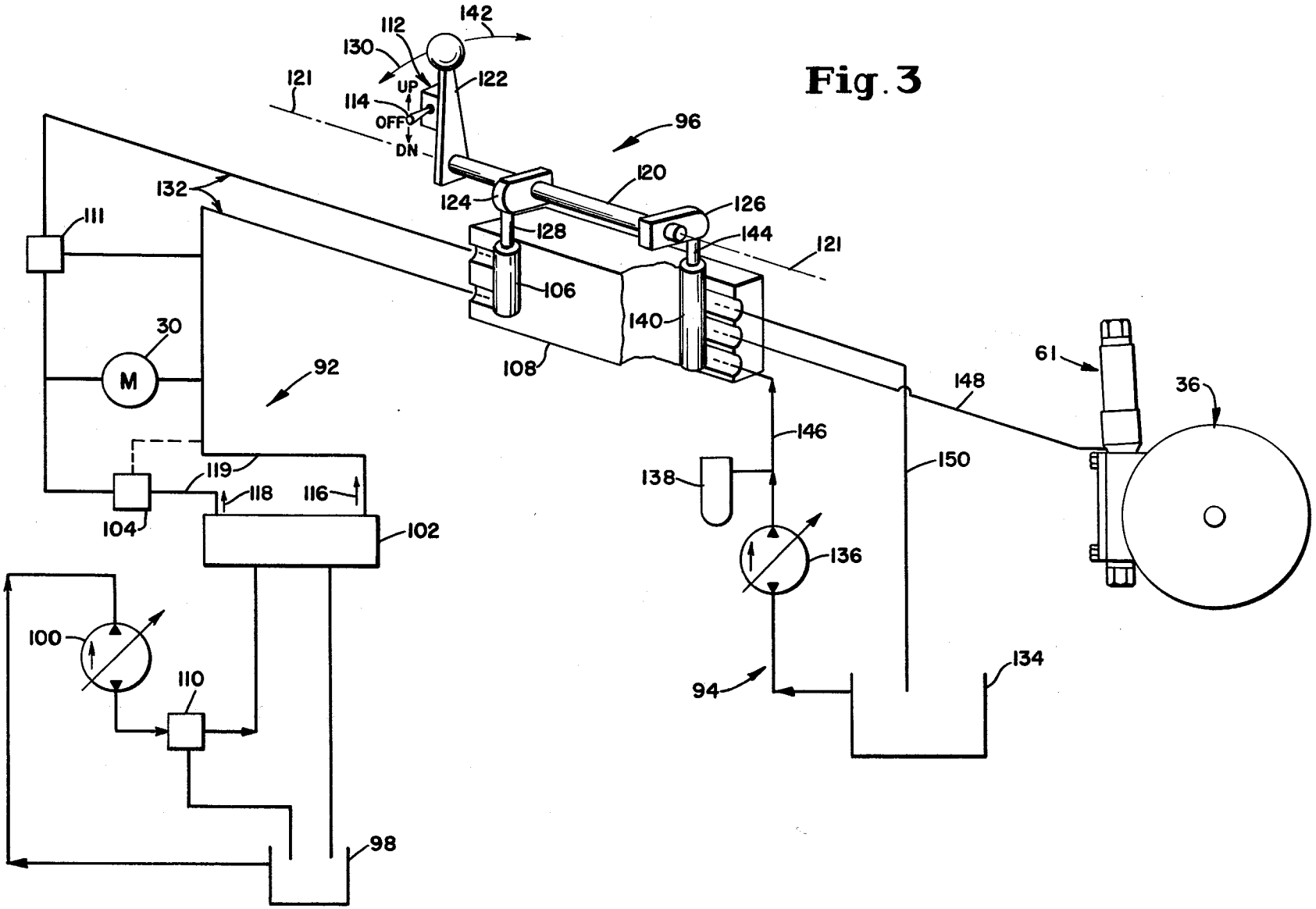
FIG. 3 shows, schematically, fluid supply and control systems for the winch which also embody and are constructed in accord with the principles of my invention.

Referring now primarily to FIG. 3, the systems employed to supply hydraulic operating fluid to winch motor 30, to control the direction of rotation and speed of that motor, and to supply hydraulic operating fluid to clutch 36 includes a motor fluid supply system 92, a fluid supply system 94 for clutch 36, and an operator manipulatable controller 96.

The system 92 provided for supplying hydraulic operating fluid to motor 30 includes a hydraulic fluid supply tank 98, a circulating pump 100, a four-way valve 102 with an A-B center block, a counterbalance valve 104, a bypass valve 106 in a valve block 108 of controller 96, and relief valves 110 and 111.

Valve 102 is a flow director. It has an electric actuator (not shown) controlled by a toggle switch 112 also included in controller 96. With the actuator 114 of the switch in the neutral position shown in FIG. 3 and pump 100 running, fluid pumped from tank 98 is bypassed through relief valve 110 back to tank 98.

If actuator 114 is moved to the "up" position shown in FIG. 3, the pump circulates the hydraulic fluid to the motor in the direction shown by arrow 116, causing the motor to rotate cable drum 24 in a lifting direction. Conversely, with the actuator depressed to the "down" position, the valve members in the flow director will be shifted in a manner which causes the pump to circulate the fluid through the motor in the opposite direction as indicated by arrow 118.

It is to be appreciated, with respect to the foregoing, that the directions "up" and "down" are significant only in those applications of my invention which involve raising and/or lowering. The same reversible flow operation can equally well be employed to move loads in horizontal directions.

Any of a number of commercially available valves may be employed for the purposes just described. Vickers, for example, makes a tandem open crossover P to T, A and B blocked control valve which is suitable for my purposes.

Counterbalance valve 104 is a fail-safe device, and it is connected across the hydraulic fluid supply and return circuit 119 between flow directing valve 102 and motor 30. If a line should rupture, pump 100 fail, or the pressure in system 92 otherwise drop, valve 104 will immediately close, putting a fluid lock on, or stalling, motor 30. This keeps the motor from rotating and, consequently, keeps cable drum 24 from rotating and dropping the load being hoisted as discussed above.

As was also indicated above, controller 96, in addition to controlling the direction of rotation of motor 30, controls the speed of that motor and, therefore, of cable drum 24.

The controller includes, in addition to the components described previously, a control shaft 120 mounted, in any conventional manner, for rotation about axis 121. Fastened to the control shaft for rotation therewith are a control lever 122 and valve actuating cams 124 and 126.

Cam 124 is positioned to engage the actuator 128 of bypass, or speed control, valve 106. It is a biased closed, modulating valve such as a spool valve, for example.

With control lever 122 in the neutral position shown in FIG. 3, and the valve closed, all of the hydraulic fluid discharged from pump 100 is circulated through motor 30, causing that motor to produce maximum torque. As the control lever is shifted in the counterclockwise direction indicated by arrow 130, cam 124 causes valve 106 to open. As this occurs, part of the hydraulic fluid is bypassed through the circuit identified by reference character 132 in FIG. 3, the amount of bypassed fluid depending upon the position of the control lever and, consequently, the extent to which the valve is opened. This reduces the amount of hydraulic fluid supplied to, and consequently the torque output of, motor 30.

Thus, the speed at which a load is raised or lowered can be readily controlled by the winch operator with maximum torque being initially available, a feature which is highly desirable in brailing and comparable applications of my invention.

Relief valve 111 is, again, a safety feature. Should excess pressure build up on the motor side of system 92, valve 111 will open, connecting bypass circuit 132 directly to hydraulic fluid supply tank 98 through flow directing valve 102 to relieve the pressure.

To summarize then, system 92 and the components of controller 96 thus far described allow winch 20 to be operated over a continuous speed range in both directions with maximum torque being available concurrently with the initial activation of the motor.

The hydraulic, clutch actuating system 94 referred to above provides a novel mode of winch operation in that it allows loads to be dropped by free fall or lowered at a speed selectable from a continuous range independently of the operation of winch motor 30.

System 94 includes a hydraulic fluid supply tank 134 (which may be combined with supply tank 98), a hydraulic fluid circulation pump 136, an accumulator 138 which keeps pressure in the system, and a spool type or other modulating valve 140 in the block 108 of controller 96.

With control lever 122 and the actuator 114 of toggle switch 112 in the neutral positions shown in FIG. 3, motor 30 is stalled by the closing of counterbalance valve 104; and clutch 36 is engaged by the action of spring 74, keeping cable drum 24 stationary. Clutch 36 can, from this point, be disengaged at a controlled rate, permitting a load to be lowered over a continuous speed range up to free fall by shifting control lever 122 in the clockwise direction indicated by arrow 142.

Specifically, as the control lever is shifted clockwise, the cam 126 on control shaft 120 depresses the actuator 144 of valve 140, providing fluid communication between hydraulic lines 146 and 148 and, consequently, supplying hydraulic fluid to the interior of clutch mechanism hydraulic cylinder 62 through port 86 and against piston 66. This compresses spring 74, releasing the pressure upon clutch lining 58 and band 60, thereby allowing cable drum 24 to rotate under the force exerted by the load being handled.

As control lever 122 is shifted further in the clockwise direction, the pressure thus imparted to piston 66 is increased, allowing the load to drop at a faster rate. Finally, with the control lever shifted to the clockwise limit, the clutch is completely disengaged; and the load can fall freely. As discussed above, this, also, is a particular advantage in brailing and similar operations.

Pump 136 circulates to valve 140 hydraulic fluid in excess of that required to operate clutch 36 except in free fall operation of the latter. The excess hydraulic fluid is circulated back to supply tank 134 through the valve and a third hydraulic line 150.

It will be appreciated from the foregoing that the novel systems just described afford a virtually limitless control over the movement of a load being handled by winch 20. For example, a load may be raised or lowered at the maximum speed afforded by motor 30 or shifted with the motor operating at maximum speed from one direction to the other. Or, a load may be raised at a slower speed and then almost instantaneously dropped at any speed up to free fall simply by shifting control lever 122. Other combinations of movement, both in speed and direction, can be obtained in rapid sequence simply by the shifting of lever 122 and the manipulation of toggle switch actuator 114.

For the most part, the components of the hydraulic fluid circulating and control systems discussed above have not been described in detail. That is because those components are, to a large extent, of conventional or commercial construction and because my invention resides in the manner in which those components are employed and controlled, rather than in their details.

Many valuable modifications and variations of the novel systems just described will be apparent to those skilled in the arts to which my invention relates. For example, because the manipulation of toggle switch actuator 114 and control lever 122 is a one-handed operation, the systems shown in FIG. 3 may be employed to control two hydraulic winches by one operator simply by duplicating the control levers, toggle switches, and control valves. Also, it will be apparent to those to whom this disclosure is directed that systems of the type shown in FIG. 3 may be employed with other hydraulic winches; and, conversely, that the latter may be operated and controlled by different types of systems.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent is:

1. A hydraulic winch comprising: a rotatably mounted cable drum; a hydraulic motor for rotating said drum; means including a hydraulically operated, biased engaged clutch drive-connecting said motor to said cable drum; means for effecting a flow of operating fluid to said motor and to said clutch including first and second flow control valves for respectively controlling the flow of fluid to said motor and to said clutch; and an operator actuatable controller which is continuously displacable from a neutral position toward a first limit position for so controlling the operation of the second flow control valve of said flow effecting means that, as the controller is displaced from said neutral position toward said first limit position, the flow of fluid to said clutch is increased and an increasing, clutch disengaging, hydraulic force is exerted on said clutch, thereby allowing a load to be lowered at an operator selected rate independently of the speed or direction of rotation of said motor.

2. A hydraulic winch comprising: a rotatably mounted cable drum; a hydraulic motor for rotating said drum; means including a hydraulically operated, biased engaged clutch drive-connecting said motor to said cable drum; means for effecting a flow of operating fluid to said motor and to said clutch; a first operator actuatable controller which is continuously displacable from a neutral position toward a first limit position for so controlling the operation of said flow effecting means that, as the controller is displaced from said neutral position toward said first limit position, an increasing, clutch disengaging, hydraulic force is exerted on said clutch, thereby allowing a load to be lowered at an operator selected rate independently of the speed or direction of rotation of said motor, and a second operator actuatable means for so controlling said flow effecting means as to control the direction in which the fluid flows through, and thereby the direction of rotation of, said motor.

3. A hydraulic winch comprising: a rotatably mounted cable drum; a hydraulic motor for rotating said drum; means including a hydraulically operated, biased engaged clutch drive-connecting said motor to said cable drum; means for effecting a flow of operating fluid to said motor and to said clutch; and an operator actuatable controller which is continuously displacable from a neutral position toward a first limit position for so controlling the operation of said flow effecting means that, as the controller is displaced from said neutral position toward said first limit position, an increasing, clutch disengaging, hydraulic force is exerted on said clutch, thereby allowing a load to be lowered at an operator selected rate independently of the speed or direction of rotation of said motor, said operator actuatable controller also being displacable from said neutral position toward a second limit position and said flow effecting means including a fluid bypass means so actuated by said controller that, as said controller is moved toward said second limit position, increasing amounts of operating fluid are diverted from said motor to thereby reduce the torque generated by the motor.

4. A hydraulic winch as defined in claim 2 in which said operator actuatable controller is displacable from said neutral position toward a second limit position and wherein said flow effecting means includes a fluid bypass means so actuated by said controller that, as said controller is moved toward said second limit position, increasing amounts of operating fluid are diverted from said motor to thereby reduce the torque generated by the motor.

5. A hydraulic winch as defined in claim 3 wherein the fluid bypass means of said flow effecting means includes a modulating valve for diverting fluid around said motor, wherein said flow effecting means includes a second valve means for directing fluid to said motor in directions effecting rotation of said motor in opposite directions as selected by the winch operator, wherein said operator actuatable controller includes cam means for operating said modulating valve, and wherein said second operator actuatable means comprises a three-position switch means.

6. A hydraulic winch as defined in claim 5 in which said flow effecting means includes a second modulating valve for controlling the flow of fluid to said clutch and wherein said operator actuatable controller includes a second cam means for operating said second modulating valve.

7. A hydraulic winch as defined in claim 6 which includes a single valve block housing both said first and said second modulating valves.

8. A hydraulic winch as defined in claim 5 in which said operator actuatable controller includes a control member movable by an operator from said neutral position toward said first and second limit positions and wherein said switch means is mounted on said control member.

9. A hydraulic winch as defined in claim 1 in which said flow effecting means includes means automatically operable in the event of a failure therein to halt the flow of fluid through and thereby lock said motor against rotation, said last-mentioned means and said biased engaged clutch thereby combining to keep a load being raised by the winch from dropping in the event of such failure.

10. A hydraulic winch comprising: a rotatably mounted cable drum; a hydraulic motor for rotating said drum; means for circulating operating fluid through said motor; a first, operator actuatable means for controlling the rate of circulation of said fluid through said motor and the consequent rate of rotation of the cable drum; a flow directing and on-off means in series with said fluid circulation rate controlling means for controlling the flow of fluid to said motor and the direction in which the fluid flows therethrough; and a second, operator actuatable means for controlling the operation of said flow directing means, said last-mentioned means having a position in which said flow directing means is operable to block the flow of operating fluid to said motor.

11. A hydraulic winch as defined in claim 10 which includes a hydraulic fluid supply means, wherein the means for circulating operating fluid through said motor includes a pump, wherein the flow directing and on-off means includes a flow directing valve means, and wherein the winch also includes a relief valve in series with said supply means, said relief valve also being in parallel with said flow directing valve means whereby, with said pump operating and the aforesaid flow directing valve means closed, fluid discharged from said pump is returned through said relief valve to said hydraulic fluid supply means, said fluid thereby being immediately available to operate said motor upon the actuation of said flow directing means by said second operator actuatable means.

12. A hydraulic winch as defined in claim 1 which also includes means for locking said motor against rotation upon a failure in the means for effecting the flow of operating fluid to said clutch and said motor whereby, if a failure as aforesaid occurs, the clutch will automatically engage and the motor lock to keep said winch from dropping the load being handled by said winch.

13. A hydraulic winch as defined in claim 12 wherein the means for supplying hydraulic fluid to said motor comprises a hydraulic fluid supply and return circuit and wherein the means for locking said motor against rotation comprises a pressure responsive counterbalance valve in said supply and return circuit.

14. A hydraulic winch as defined in claim 12 wherein the means drive-connecting said motor to said cable drum includes a planetary gear reduction drive comprising an internal ring gear and wherein said clutch includes means operable with said clutch engaged to keep said internal ring gear from rotating.

15. A hydraulic winch as defined in claim 1 which also includes a housing; wherein said cable drum is a shaft supported cable drum rotatably mounted in said housing and the means drive connecting said motor to said cable drum includes a reduction drive for rotating said cable drum, said reduction drive comprising planetary gears, an internal ring gear meshed with said planetary gears, and a planetary gear carrier rotatable with said cable drum; said clutch being composed of a lining and a band with one stationary end and one free end surrounding said ring gear; and said winch also including means for biasing the free end of said clutch band toward the stationary end thereof to brake said ring gear and said cable drum and for displacing said free end away from said stationary end to free said ring gear and cable drum for rotation, said last-mentioned means comprising a hydraulic cylinder, a piston in said cylinder and connected to the free end of said clutch band, spring means in said cylinder for biasing said piston in a ring gear braking direction, and means via which hydraulic fluid can be introduced into said cylinder to displace said piston in the opposite direction against the bias of the spring means to free said internal gear and said cable drum for rotation.

16. A hydraulic winch as defined in claim 15 wherein said reduction drive includes a sun gear meshed with said planetary gears and said hydraulic motor is drivingly connected to said sun gear, said winch also including means for automatically locking said motor and said sun gear against rotation concurrently with a failure in the means for effecting the flow of hydraulic fluid to said motor and to said clutch whereby, in the event of a failure, the locking of said motor by said last-mentioned means and the braking of said ring gear by said clutch biasing means will keep said cable drum from rotating and dropping a load being lifted by said winch.

* * * * *

UNITED STATES PATENT OFFICE

CERTIFICATE OF CORRECTION

Patent No. 4,312,497 Dated January 26, 1982

Inventor(s) Haskell M. Whaley

It is certified that error appears in the above-identified patent and that said Letters Patent are hereby corrected as shown below:

Column 1, line 25, "tune"should be --tuna--.

Column 1, line 51, "common" should be --uncommon--.

Column 2, line 3, "fallsafe" should be --fail-safe--.

Column 3, line 22, "abovesuggested" should be --above-suggested--.

Signed and Sealed this

Seventh Day of September 1982

[SEAL]

Attest:

GERALD J. MOSSINGHOFF

Attesting Officer

Commissioner of Patents and Trademarks